US010125580B2

(12) United States Patent
Andersen

(10) Patent No.: US 10,125,580 B2
(45) Date of Patent: Nov. 13, 2018

(54) SAND SCREEN FOR SAND CONTROL IN LATERAL HOLES IN WELLS

(71) Applicant: Gantech AS, Mathopen (NO)

(72) Inventor: Gunnar Andersen, Mathopen (NO)

(73) Assignee: Gantech AS, Mathopen (NO)

( * ) Notice: Subject to any disclaimer, the term of this patent is extended or adjusted under 35 U.S.C. 154(b) by 119 days.

(21) Appl. No.: 15/343,683

(22) Filed: Nov. 4, 2016

(65) Prior Publication Data

US 2017/0152731 A1 Jun. 1, 2017

(30) Foreign Application Priority Data

Dec. 1, 2015 (NO) ..... 20151638

(51) Int. Cl.
*E21B 43/08* (2006.01)
*E21B 34/06* (2006.01)

(52) U.S. Cl.
CPC ..... *E21B 43/084* (2013.01); *E21B 34/06* (2013.01); *E21B 43/088* (2013.01)

(58) Field of Classification Search
CPC ..... E21B 43/08; E21B 43/088; E21B 43/084; E21B 34/06
See application file for complete search history.

(56) References Cited

U.S. PATENT DOCUMENTS

| | | | |
|---|---|---|---|
| 5,311,942 A | 5/1994 | Nagaoka | |
| 6,189,629 B1 | 2/2001 | McLeod et al. | |
| 6,394,185 B1 | 5/2002 | Constien | |
| 8,813,844 B2 | 8/2014 | Hopkins et al. | |
| 2002/0088744 A1 | 7/2002 | Echols et al. | |
| 2004/0026313 A1* | 2/2004 | Arlon Fischer | B01D 29/111 210/484 |
| 2004/0159435 A1 | 8/2004 | Plucheck et al. | |
| 2009/0101363 A1 | 4/2009 | Teixeira | |

FOREIGN PATENT DOCUMENTS

| | | |
|---|---|---|
| EP | 0116181 A1 | 8/1984 |
| EP | 0607809 A1 | 7/1994 |
| EP | 0674095 A2 | 9/1995 |
| WO | 2013036133 A1 | 3/2013 |

OTHER PUBLICATIONS

Search Report issued in corresponding Norwegian Application No. 20151638, dated Jun. 8, 2016 (2 pages).

* cited by examiner

*Primary Examiner* — Yong-Suk Ro
(74) *Attorney, Agent, or Firm* — Osha Liang LLP

(57) ABSTRACT

A sand screen for installation in a well includes a flow-through element having a center line running in the longitudinal direction of the flow-through element; and a filtration device. The flow-through element has an internal cavity extending over at least parts of a length of the flow-through element. There are a plurality of openings over the length of the flow-through element. The openings, via the filtration device, provide communication between an outer surface of the flow-through element and the internal cavity. The sand screen is flexible in a radial direction and in an axial direction.

11 Claims, 22 Drawing Sheets

Section C-C

Section D-D

Section F-F

Section G-G

Swction J-J

SAND SCREEN FOR SAND CONTROL IN LATERAL HOLES IN WELLS

FIELD OF THE INVENTION

The invention relates to a sand screen for use in wells. The sand screen is especially useful in lateral holes. The sand screen prevents the inflow of sand and particles into the lateral hole, and it also prevents the lateral hole from collapsing and closing wholly or partly as a result of inadequate formation strength. The sand screen may be made up of one or more similar and/or dissimilar components in order to obtain the desired effect.

BACKGROUND OF THE INVENTION

A multitude of different methods are previously known for preventing the production of sand from wells. These methods are known under the generic term "sand control". Sand control is used in wells that produce oil, gas and/or water, and it can also be installed in wells used for injection of water and/or gas. The purpose of installing some form or other of sand control in a well is to prevent sand and/or other particles from the formation from accompanying the flow of produced or injected fluid into the well itself. Most of the methods are characterised by the installation of some form of mechanical equipment in the actual borehole/well. Many of the methods also involve placing, by means of pumping specific fluids, specially adapted sand or particles of other material either in the space between the sand screen and the formation and/or into perforations within the formation.

There are also chemical methods for preventing sand production. In these methods, chemicals are used, which are pumped into the formation in order to increase formation strength and prevent failure. It is such formation failure that in turn leads to sand production. In addition, it is an alternative to coat specially adapted sand or particles of other material with chemicals that bind the particles together after they have been placed inside perforations. The actual placement of the chemicals, either with or without the addition of other particles, is carried out by pumping chemicals into the well with the aid of various fluids, such as carrier or displacement fluids.

A less used, but nonetheless efficient method of sand control is to perforate the well in formations that are consolidated and then fracture these formations. These cracks or fractures, which are made by pumping fluid into the well at a pressure that exceeds the fracturing pressure of the formation, grow within the formations, which are basically too weak to be produced without some form of sand control. This is called "Indirect Vertical Fracture Completion". The fracture, which is formed by the fluids pumped into the well, is filled with sand or particles of another material such as to prevent the fractures from closing after the operation has been completed and the pump pressure has been removed. These fractures act as good flow paths for formation fluids from the unconsolidated formation, which can now flow into the well without taking with them particles from the formation.

The object of the earliest sand control methods was to place a "filter" in the well, i.e., a filter that prevented sand and particles from the formation from entering the well. Current technology is more sophisticated. Today, it is desirable that small and harmless particles should accompany the fluid flow from the reservoir into the well and up to the surface. The production of these small particles out of the well and also out of the sand control equipment itself results in a longer useful life for the well and the equipment. In addition, the fluids produced can have a higher volume flow because the pressure loss through the sand control equipment will be lower than if also the small particles were to be retained. The terminology used about today's more sophisticated methods is "propping the formation", as opposed to the earlier filter analogy.

With the exception of the chemical methods, today's sand control methods and equipment are unsuitable for use in small lateral holes. Lateral holes should be understood as holes that extend from the main well at an angle of up to 90° compared with the angle of the motherbore. In some instances, the angle may be more than 90°. A common feature of all of today's sand control methods is that pipes of relatively large dimensions are installed in the well itself. These pipes, which have many different designs and configurations, are placed within the producing formation (or within the formation to be injected into). Such pipes are rigid structures of large diameter and large bending radius, and common to them all is that the dimensions are adapted to the diameter of the well itself, which means that they cannot be run out into or installed in small lateral holes.

The simplest form of sand control is to use a liner with milled-out slots in the longitudinal direction of the liner. In the industry these are known as a "slotted liner". These special slotted liners are placed at a depth in the well where the producing formations are located, and they prevent sand and/or other particles from the formation from accompanying the liquid/gas flow, whilst the milled-out slots/sieves allow liquid and/or gas to flow into or out of the well. The size of the milled-out slots/sieves is adapted to the size of the sand and the particles found in the specific formation.

A common feature of the pieces of equipment referred to as screens is that they have a base pipe and that the actual mechanism for stopping the sand production lies as an integral part on the outside of the base pipe. This mechanism for stopping the sand and particle production is called a screen. Liquid and/or gas from the formation thus flows through the screen on the outside of the base pipe, then in through one or more holes in the base pipe and into the well itself. The screen on the outside of the base pipe is adapted to the size of the sand and particles in the formation such that the sand and particles are prevented from entering into the well itself. A very common sand screen structure that is used on the outside of the base pipe to stop sand production employs an equilateral metal wire with a trapezoid cross-section that is spiraled around the base pipe with a given space between each winding. Another method is to lay different layers of fine-meshed netting on the exterior of the base pipe. Some of the different layers may have the purpose of providing strength, whilst others are designed to stop sand production. On the outside again, that is to say, on the very exterior of screens of this type, there is a layer that is to protect the wire netting or mesh. This layer may, for example, have the form of a perforated pipe. There are also base pipes that are provided with ceramic rings on the outside. These are positioned with a spacing that is adapted to the size of the sand and the particles in the formation such that liquid and/or gas flows through and into the interior of the base pipe whilst the sand and particles are stopped. Outermost on screens of this type there may also be a perforated pipe that protects the ceramic rings themselves during both installation and production.

Lastly, there are screens which, on the outside of the base pipe, have a layer of specially adapted sand or particles of other material that are cemented together using chemicals of different types. Often a form of resin is used. On the exterior, there is in turn found yet another mechanical device which may have the form of an outer perforated pipe or of an equilateral metal wire with a trapezoid cross-section that is wound around the base pipe with a given space between each winding. The base pipe and the outer pipe form a chamber that locks in place the chemically cemented and specially adapted sand or particles. This solution is referred to as "pre-packed screens".

Today, as a step towards increasing productivity, extending useful life and time at plateau production, the industry has started to construct small lateral holes out from the main well. These can be described as perforations. A main difference is that the perforations are much shorter in length than the lateral holes. Whilst the perforations can be up to two to three feet (0.6-0.9 meters) in length, lateral holes can be up to several hundred feet (up to several hundred meters) long. And whilst the perforations are made by means of directed blasting charges that are fired downhole, there are different methods for constructing the lateral holes, but a common feature of perforations and lateral holes is that they are at about 90 degrees to the well itself. Both perforations and lateral holes are formed after the actual well has been drilled, and usually also after the well has been completed. The well is thus drilled first, and then a liner and/or casing is installed in the well at the same level as the actual formation. This pipe is cemented in place by pumping cement out to the exterior of the pipe, i.e., between the pipe and the formation. Exterior to this cement lie the producing formations. To obtain contact between the formation and the well itself, the decision may be made to perforate the well and/or drill lateral holes. When lateral holes are to be drilled, tools are run into the well that first drill holes in the actual liner or casing. These holes are often around 2.5 cm in diameter (one inch). Then a tool is run into the well that is capable of drilling the actual lateral hole a long way out and away from the main well and into the formation. A frequently employed method is to use nozzles and liquids that flush away the formation, thereby making a lateral hole in the formation and at an ever-increasing distance from the well. The diameter and length of these lateral holes can vary according to need, drilling time used and the equipment employed. Today, equipment exists that can drill up to several lateral holes at one and the same depth in the well. With the exception of WO 2013/036133 A1, the equipment that has drilled the lateral hole is pulled out of the well after the operation has been completed. WO 2013/036133 A1 describes a system where the equipment is left in the lateral holes after drilling. During the production phase, liquid flows from the formation into the annulus between the drilling equipment and the formation and into the well itself. This method provides no sand control in the lateral holes themselves.

Lateral holes, too, may collapse or have limited production/volume flow owing to production of sand or particles from the formation. They therefore require a form of sand control such as to be able to justify the economics of the project through sand-free production of hydrocarbons and/or water, or injection of water and/or gas. An alternative may be to use the chemical methods that are available, but the systems that will fill the lateral hole with specially adapted sand or particles of another material are particularly unfavourable in such completions. This is because the methods result in a dramatic increase in the pressure drop for liquid and/or gas that is to flow through the lateral hole. This pressure drop can be modelled using Darcy's Law for linear flow through a porous material. Today's various sand screens are of a size, design and construction that prevent them from being installed in lateral holes. They are too large and rigid, and their design and construction also mean they cannot be scaled down to the dimensions required for lateral holes. Even if today's various sand screens could be scaled down, they would have a moment of resistance to bending that is too great to allow them to be installed in a lateral hole. A sand screen that is to be run into a lateral hole must be bendable at an angle of 90 degrees inside a liner or casing that has an internal diameter of 255 millimeters (10¾") or less. In addition, this type of sand screen must have an external diameter that is smaller than the hole drilled in the liner or casing itself. Normally, this hole will be around 2.5 cm, but it may be larger or it may be smaller.

SUMMARY OF THE INVENTION

The invention is defined in the independent claim, whilst the dependent claims disclose alternative embodiments of the invention.

A sand screen for installation in a well is described, comprising a flow-through element with a centre line running in the longitudinal direction of the flow-through element; and a filtration device, where the flow-through element has an internal cavity extending over at least parts of the length of the flow-through element, and where the flow-through element is further configured with a plurality of openings along its length, the openings, via the filtration device, providing communication between an outer surface of the flow-through element and the internal cavity, and where the sand screen is flexible in a radial direction and in an axial direction.

The sand screen, according to the invention, has many exemplary embodiments. Common to them all is that the sand screen has a short/small bending radius that is necessary for it to be installed inside a lateral hole. This means that the sand screen can be bent substantially per length meter, for example, at least 90° over a length of 30 cm, but is not limited to this as it is able to allow both more and less bending. This bending radius is provided by a sand screen that is flexible in a radial and axial direction, i.e., that the sand screen can be bent in all directions. This means that the sand screen can be compressed, extended and bent 360° relative to the centre line of the flow-through element. That the sand screen is flexible in the radial direction should be understood to mean that it is flexible in a transversal direction relative to the centre line, and that the sand screen is flexible in the axial direction should be understood to mean that it is flexible in the direction of the centre line/longitudinal direction of the sand screen.

Furthermore, all the flow-through elements in the different exemplary embodiments of the sand screen are able to allow liquids and/or gas through, whilst they are capable of wholly or partly stopping sand and particles from accompanying liquid and/or gas from the exterior to the interior of the sand screen. All the exemplary embodiments of the flow-through elements have an internal cavity, also referred to as a flow passage or internal area, which enables liquid and gas to flow in one or other direction from one end to the other. The flow-through element has a centre line running along the length thereof, regardless of whether the flow-through element is straight or curved bent.

Furthermore, the flow-through element in all the exemplary embodiments of the sand screen is configured with a continuous surface, in which continuous surface the openings are arranged. This means that in the present sand screen irregular through holes will not be formed in the flow-through element, in which irregular through holes sand or other particles can become stuck during the running-in of the sand screen from a main well into a lateral well, and accompany the sand screen into the lateral well. The present sand screen therefore reduces the risk of the sand screen being rendered ineffective during installation in that particles or similar contaminating elements damage the structure.

The flow-through element has, in all the exemplary embodiments of the invention, a centre line running in the longitudinal direction of the flow-through element, where the flow-through element has an alternating external diameter, i.e., the external diameter alternates between a large and a small external diameter along the longitudinal direction of the flow-through element. Thus, in all of the embodiments of the flow-through-element, the flow-through element has a tubular bellows shape with alternating external diameter. The tubular bellows shape can be formed by a pipe, a spiral pipe, a framework or a bellows.

The filtration device can be arranged on the inside or the outside of the flow-through element, thus covering the plurality of openings in the flow-through element. The openings cover at least parts of the surface of the flow-through element, from a small part up to the whole length.

The flow-through element can comprise a pipe, a framework, a spiral pipe or a bellows.

The filtration device can be constituted of wires in the form of a woven mesh, a braided mesh or spiral wires.

The sand screen can be arranged such that it comprises one or more layers layered in the radial direction of the sand screen. A sand screen can be constructed such that these layers have different structure and function. One of these layers, i.e., the flow-through element, can have a frame function which maintains the shape of the sand screen, whilst one or more layers, i.e., the filtration device, may have the function of preventing or reducing the possibility of sand and/or particles coming from the underground into the inner passage of the sand screen. One or more of the filtration devices can be placed on the outside of the frame function. One or more of the filtration devices can be placed on the inside of the frame function. One or more of the filtration devices can be placed both on the inside and also on the outside of the frame function, such that they cover the openings in the flow-through element.

The wires can be arranged in such a way in relation to one another that the inflow area increases in the direction of the centre line of the flow-through element. In an aspect, the wires may be configured with a cross-section that decreases from an outer surface of the filtration device to an inner surface thereof, and where subsequent wire or wires, over the length of the filtration device, form an inflow area between them. The wires may have different cross-sections, for example, a trapezoid form. Alternatively, the wires can have a triangular cross-section, which will have a similar effect to wires with a trapezoid cross-section. The principle of using a trapezoid or triangular cross-section is the same, i.e., that sand is to be stopped from entering the gap or slot between the wires. If sand gets in through the narrow gap, it will then flow into the well and out of it. It is therefore desirable to prevent sand from gathering between the wires. Trapezoid wire is called "wire wrap" in the field of sand control. The wires lie adjacent to each other such that there are slot openings between them. The purpose of the trapezoid shape is to ensure that if a particle gets through the slot opening between two wires, it will go straight through and not become stuck between the wires.

The sand screen can, in an aspect, comprise at least one spacer on an outer surface thereof. If the flow-through element is a pipe, the spacer will be on an outer radial surface of the sand screen. The object of these spacers is to protect the sand screen during installation.

The sand screen can further comprise a termination. This termination can be in the form of a tip that prevents liquid and/or gas and also sand and particles from the formation from entering into the interior of the sand screen. According to an aspect, the tip can have a coating applied and it can be fluid-tight. The tip can be configured to remain innermost inside the lateral hole after installation (furthest away from the main well) and prevent sand, liquid and/or gas from flowing into and through the tip of the sand screen. According to one or more embodiments of the invention, this tip, in some cases, can be arranged such that during installation it helps to introduce the sand screen into and pass it out along the lateral hole itself. The termination can, according to an aspect of one or more embodiments of the invention, be fluid-tight. According to an exemplary embodiment, the tip can be configured as a hemisphere, whilst the tip in another exemplary embodiment can be configured as a cone. In both these exemplary embodiments, the tip can also have mounted thereon mechanical devices such as mechanical teeth and/or helical wings. There are several physical configurations of the tip, as for instance helical, concave or convex faces. In addition to innumerable physical configurations, the tip may also have different materials applied in order to obtain different effects. In an exemplary embodiment, the tip can be coated with teflon or other materials that are both plastic and/or elastic as, for example, grease and/or wax. The purpose of these exemplary embodiments may be preservation of the material in the tip, easier installation or to improve the physical conditions for the success of the operation and/or the optimal functioning of the sand screen under the conditions prevailing at any given time.

According to an exemplary embodiment, the termination may comprise one or more of the following elements, listed going from outermost on the termination and backwards (as installed):

- A nozzle capable of drilling out the lateral hole using liquid
- A one-way valve, for example, a flap valve or a spring-loaded ball valve, which prevents liquid and/or gas and other particles from flowing from the formation into the inner cavity in the sand screen both during the actual drilling of the lateral hole and after the drilling has been completed and the wells have been put into production
- A release mechanism, which, for example, can be activated by pressure, temperature, chemicals or mechanically, and which thus physically separates the tip and the sand screen from a hydraulic hose (drill string)
- A release mechanism, which, for example, can be activated by pressure, temperature, chemicals or mechanically, and which thus physically separates the tip and the sand screen from a flexible drill string
- A vibrating or rotating drill bit for drilling out the lateral hole, this drill bit being provided with nozzles through which liquid flows out and removes cuttings from the lateral hole In this exemplary embodiment, the actual sand screen can be installed simultaneously with the drilling of the lateral hole. In this same exemplary embodiment, the sand screen can be sealed with a sealing material such that liquid and cuttings from the drilling of the lateral hole can flow in the annulus between the sand screen and the formation and into the well itself. The sealing material in this exemplary embodiment may be wax or other materials that can be removed either by means of temperature and/or on contact with and/or through the action of different chemicals. When the drilling of the lateral hole has been completed and the sand screen has been installed, the release mechanism can break the mechanical connection between the hydraulic hose that has supplied liquid during the drilling operation and the one-way valve. Thus, the hydraulic hose can be pulled out of the lateral hole and up to the surface. In an exemplary embodiment, the one-way valve and the release mechanism can be placed in the area of or in very close proximity to another termination, for example, an end piece. In an alternative embodiment, a flexible drill string can be used instead of the hydraulic hose.

According to an aspect, the sand screen may have at least one layer of material applied, which at least reduces fluid communication between an outer surface of the sand screen and the internal cavity. This at least one layer may be suitable for removal when necessary by activating a change in pressure, temperature and/or chemicals.

The sand screen according to one or more embodiments of the invention can comprise one or more similar or dissimilar flow-through elements put together in such a way as to form a sand screen, and so that this sand screen can be installed in lateral holes under the prevailing physical conditions found in each individual well. This means to say that the sand screen according to one or more embodiments of the invention has a short bending radius, and it may have a small diameter, it may have a length adapted to the individual lateral hole, and sufficient strength to withstand the load from the formations. Furthermore, the sand screen according to one or more embodiments of the invention is able to let liquids and/or gas through, it is capable of stopping sand and particles from accompanying liquid and/or gas from the exterior to the interior of the sand screen, and it has an inner cavity which allows liquid and gas to flow in one or the other direction from one end to the other.

The sand screen can also be combined with an end piece which forms a second termination of the sand screen and which provides a whole or partial sealing towards the well itself, preferably towards the liner or casing in the well. This end piece is configured in such a way as to prevent, block or form a restriction against sand, liquid and/or gas flowing freely from the annulus between the lateral hole and the sand screen itself and into the well in the area around the end piece.

The end pieces have many different exemplary embodiments as regards both materials selection and configuration. There are also exemplary embodiments where there is a clear connection between materials selection and configuration. In an exemplary embodiment, the end piece may be a flange that sits on a pipe section that in turn is fastened to the sand screen. The length of this pipe section is adapted, inter alia, to the wall thickness of the liner or casing, together with any other mechanical parameters such as the installation tool and necessary bending radius.

The external diameter of the flange and the external diameter of the pipe section must also be adapted to the hole that is drilled in the liner or casing itself and through which the lateral hole has been drilled. During installation of the sand screen, the flange on the end piece in this exemplary embodiment will meet the wall/material on the inside of the liner or casing, i.e., within the well, the flange thereby being able to be an indicator that the sand screen is in place. The end piece can be equipped with a coating on the outside to achieve desired sealing against the liner or casing and towards the annulus of the lateral hole. This coating may be rubber or a material that expands in contact with oil, water, gas or a given chemical.

In another exemplary embodiment, the end piece can comprise a pipe section, which is in turn fastened to the sand screen. A ring can be secured to this pipe section, which has a larger external diameter than the pipe section itself. This ring may be of different materials such as rubber or another elastic material. The external diameter of the ring and the pipe section must, inter alia, be adapted to the hole that is drilled in the liner or casing where the lateral hole has been drilled. During installation of the sand screen, the ring on the end piece will be pressed through the hole in the liner or casing, with the result that resistance will occur which can be an indicator that the sand screen is in place. When installation is completed, the ring will be on the outside of the liner or casing. In an exemplary embodiment, this ring may be made of a material that expands in contact with oil, water, gas or a given chemical.

In an exemplary embodiment, the end piece can be comprised of a pipe section that is in turn fastened to the sand screen. Attached to the outside of this pipe section may be plastic and/or elastic materials, including materials that will expand in contact with oil, water, gas or a given chemical. The external diameter of the pipe section, including the material/materials on the exterior of the pipe section, must, inter alia, be adapted to the hole that has been drilled in the liner or casing where the lateral hole has been drilled. During installation of the sand screen, the end piece will be pressed/pushed into the hole in the liner or casing, with the result that resistance will occur, which can be an indicator of the sand screen being in place. During this process, the plastic material in the exemplary embodiment can be deformed such that it alone, or together with other materials on the outside of the pipe section, forms a seal against the annulus of the lateral hole.

In the simplest exemplary embodiment, the sand screen may be comprised of a construction that has the form of one circular pipe with associated tip and end piece. This pipe is the simplest exemplary embodiment with a filtration device made of woven or braided material such that the pipe is given sufficient bendability. During the weaving or braiding of the pipe, spaces will be formed between the threads/strands in the woven or braided material, and these spaces are adapted to the size of the sand and particles in the formation such as to prevent them from entering into the interior of the pipe. It is normal, but not necessary, that the size of these spaces should comply with the prescribed standard in the oil and gas industry for such openings with a view to sand control. The pipe can be woven or braided of different materials. A common feature of these materials is that they must be selected on the basis of the conditions in the well, and in particular with regard to corrosion and useful life. It is the construction itself, and not necessarily the material, that gives the pipe the required flexibility. It will be natural to choose different types of steel which in turn comply with prescribed standards in the oil and gas industry for different well conditions. It is possible, and for some wells it may be appropriate, to use more elastic and plastic materials than steel to make the sand screen. These woven or braided materials can initially have a rectangular flat form, the two long sides being bent towards each other and fastened together so as to give the sand screen a tubular shape. Whether it is a pipe that is woven or braided or a rectangle that is subsequently folded into a pipe, all dimensions are adapted to the specific framework conditions in the well. In different exemplary embodiments, the final structure, that means to say, the sand screen, may be comprised of several layers in a radial direction of woven and/or braided material, and one layer may have a different construction and mesh width in relation to the other layer or layers, but together they will achieve the desired effect. Optionally, there may be several layers of woven and/or braided material in order to achieve a certain safety factor as regards preventing sand production, optionally whilst obtaining a desired strength and flexibility/bendability.

In another exemplary embodiment, the flow-through element in the sand screen may have the form of a tubular bellows which, in the longitudinal direction, alternates between a large and a small external diameter, i.e., that the bellows has an alternating diameter. This tubular bellows is equipped with associated tip and end piece. The said variation in external diameter can be obtained by using curved folds or by using more tapered folds. Regardless of which form is used, repetitive curved and/or straight faces will be formed on this tubular bellows. These faces are provided with openings. Mounted on the inside of these openings, and thus on the inside of the curved or straight faces on this tubular bellows, is one or more layers of woven and/or braided material, the space between the threads/strands in the woven and/or braided material being adapted to the size of the sand and particles in the formation. In another exemplary embodiment, the said faces with openings can have mounted externally one or more layers of woven and/or braided material where the space between the threads/strands in the woven/braided material is adapted to the size of the particles in the formation. In another exemplary embodiment, the said faces may have mounted thereon one or more woven and/or braided layers both on the inside and on the outside. It is this woven and/or braided material that prevents the sand and/or particles in the formation from entering into the interior of the sand screen. In all the different exemplary embodiments there may, as mentioned, be mounted one or more such woven and/or braided layers in order to achieve the desired effect as regards preventing sand production. Common to all the materials in all the exemplary embodiments is that they must be selected on the basis of the conditions in the well, and in particular with regard to corrosion and useful life. It is basically the actual construction and not necessarily the materials that give the pipe the necessary flexibility. For all the different exemplary embodiments of the invention, it will be natural to choose different steel types that in turn comply with the prescribed standard in the oil and gas industry for different well conditions. It is possible, and for some wells it may be appropriate, to use more elastic and plastic materials than steel to manufacture all the different exemplary embodiments of the sand screen.

In another exemplary embodiment, the sand screen may have the form of, and be manufactured as, a spiral or flexible pipe. This structure is equipped with associated tip and end piece. The pipe itself is equipped with holes in the actual pipe wall. Also in the case of this exemplary embodiment, there are several variants where one or more layers of woven or braided material are mounted either on the inside, on the outside or on both sides of the pipe wall.

In an exemplary embodiment, the sand screen, whatever its design or shape, can be split into shorter sections. These sections can be joined by means of a connecting piece. The connecting piece may have different exemplary embodiments such as a bellows or a spiral flexible pipe.

The sand screen according to one or more embodiments of the present invention, which sand screen comprises a flow-through element and a filtration device, has a reduced risk of being damaged during installation, and in particular in the transition from the main well to a lateral well.

These and other non-limiting embodiments of the invention will be explained in more detail with reference to the drawings, wherein:

DETAILED DESCRIPTION

Figure 1:
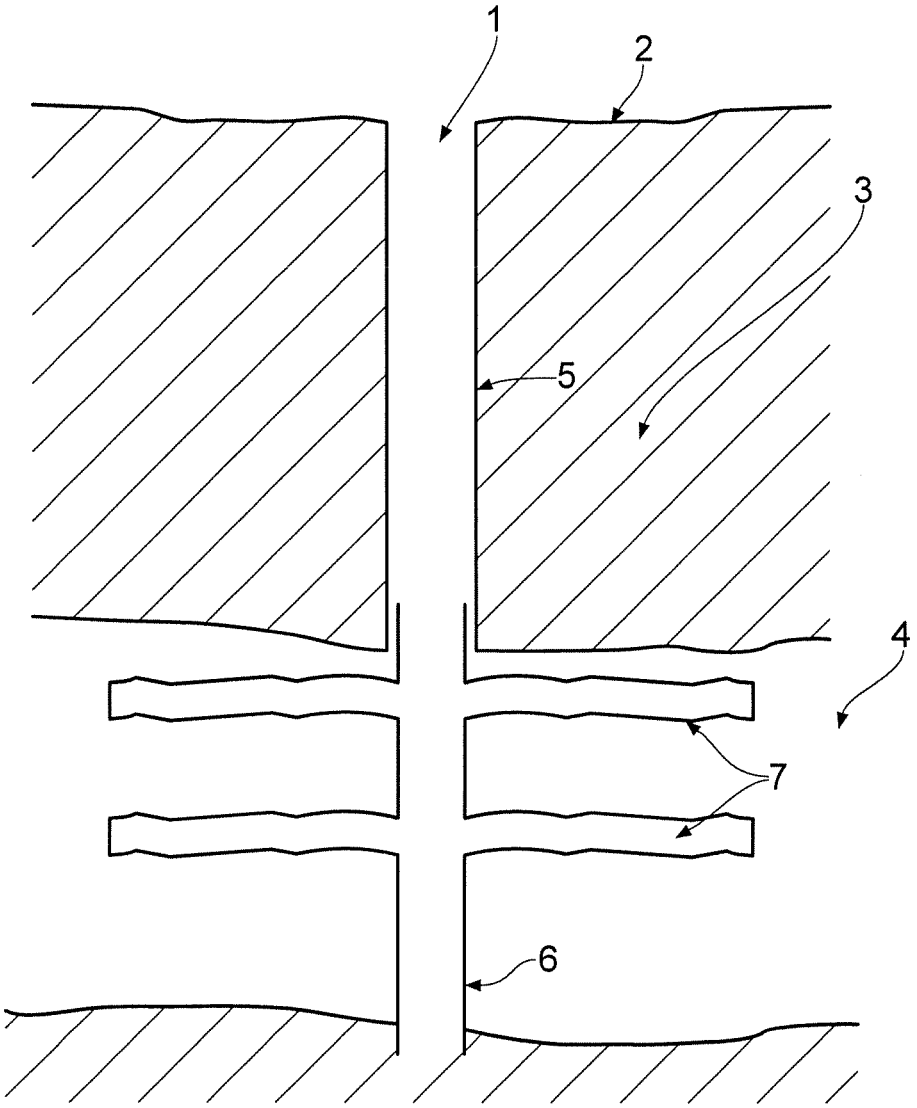
FIG. 1 is a schematic diagram of a well with associated lateral holes.

FIG. 1 shows any type of well 1 drilled from a surface 2 into the underground 3. The well 1 has also been drilled into a formation 4. The well 1 has had a casing 5 and a liner 6 installed. In this example of a well 1, four lateral holes 7 have been drilled out through the liner 6 and into the formation 4.

Figure 2:
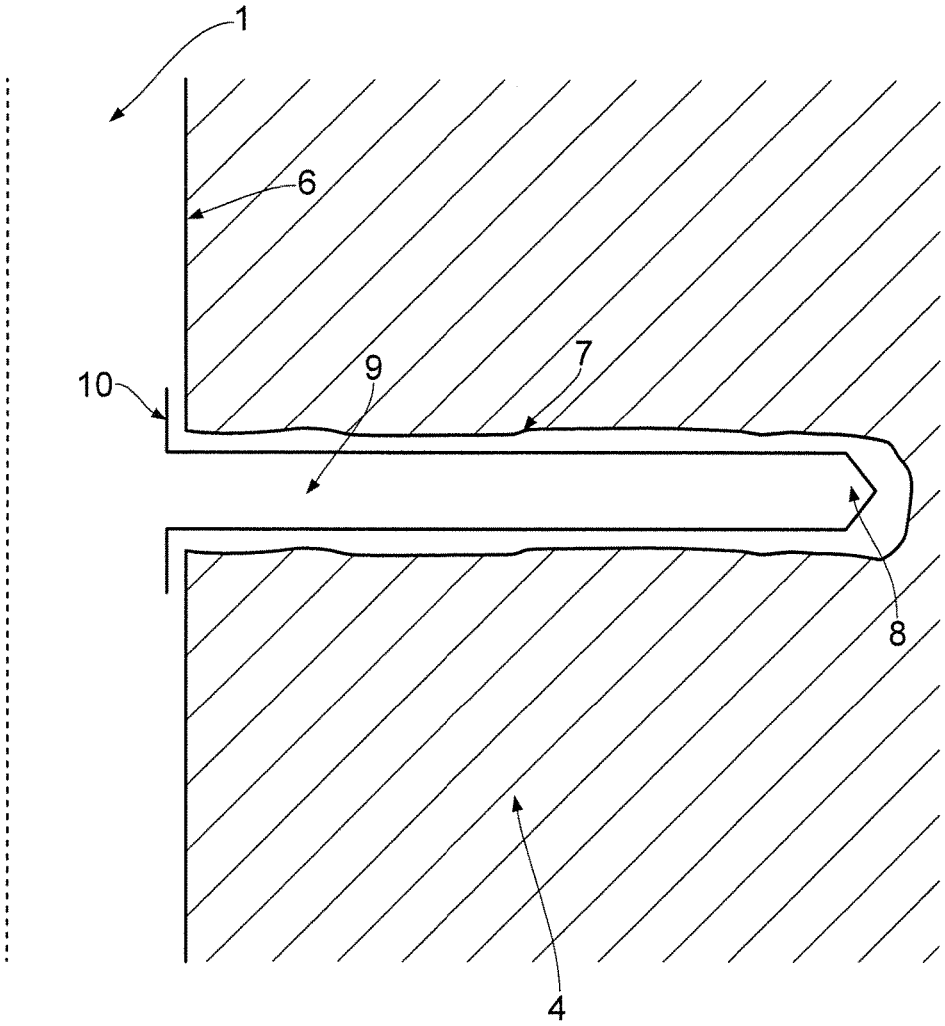
FIG. 2 is a schematic diagram of a section of a welt with an associated lateral hole in which a sand screen for sand control in lateral holes in wells has been installed.

FIG. 2 shows as an example a lateral hole 7 that has been drilled out through a liner 6 and into a formation 4. The lateral hole 7 can in some cases also be drilled out of the casing 5. A sand screen 9 according to one or more embodiments of the invention has been installed in the lateral hole 7. This sand screen 9 has been provided with a termination 8 in the form of a tip 8 and an end piece 10.

Figure 3:
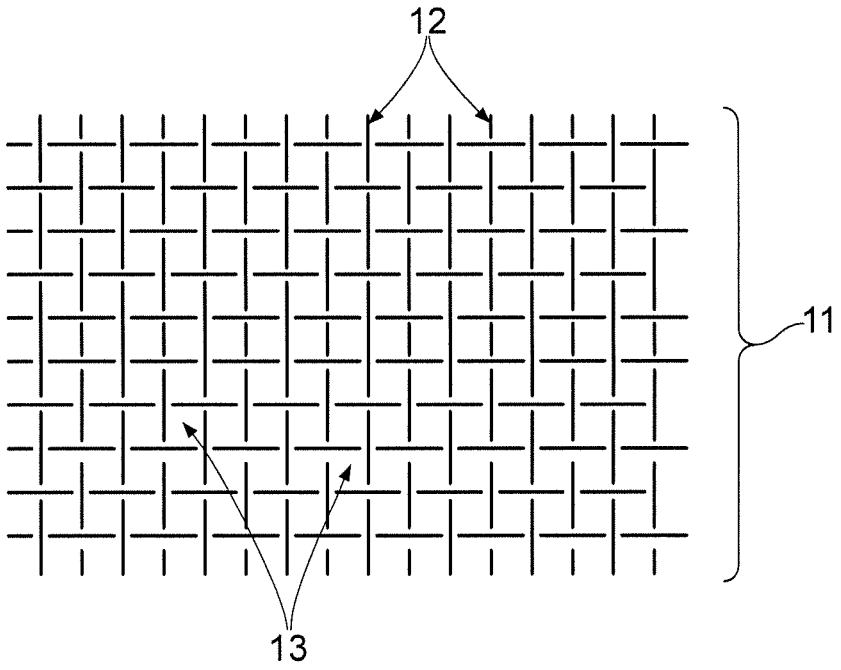
FIG. 3 is a schematic diagram of a filtration device in the form of a woven material with associated threads/strands and spaces between same.

FIG. 3 is a schematic diagram of a filtration device in the form of a woven material 11, which can be one of the elements of which the sand screen 9 is comprised of. This woven material 11 comprises of threads/strands 12, and between these threads/strands 12 are formed spaces/holes 13. The woven material 11 is produced such that it allows liquid and/or gas to pass through the spaces/holes 13, whilst sand and/or particles from the formation 4 are unable to pass through the woven material 11.

Figure 4:
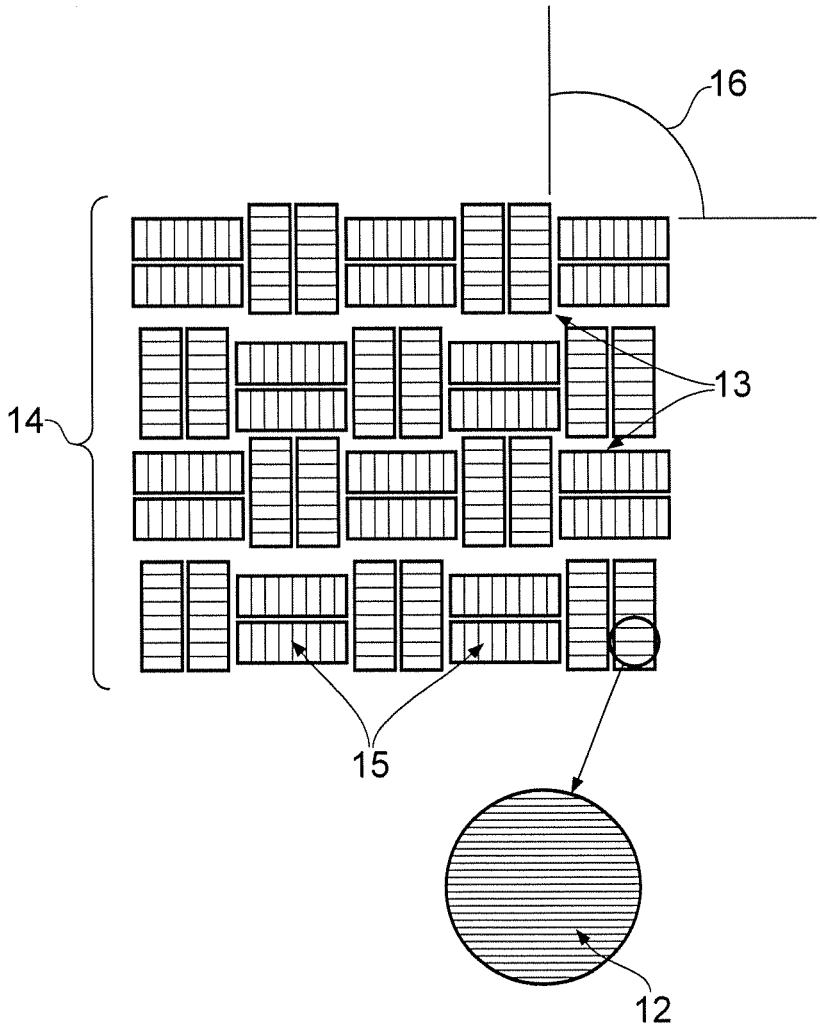
FIG. 4 is a schematic diagram of a filtration device in the form of a braided material with associated threads/strands and spaces between same.

FIG. 4 is a schematic diagram of a filtration device in the form of a braided material 14, which can be one of the elements of which the sand screen 9 is comprised of. This braided material 14 comprises bands 15 which in turn can be made up of one or more threads/strands 12, and between these bands 15 are formed spaces/holes 13. The braided material 14 is produced/manufactured such that it allows liquid and/or gas to pass through the spaces/holes 13, whilst sand and/or particles from the formation 4 are unable to pass through the braided material 14. The reciprocal angle 16 between the bands 15 in the braided material 14 is, in FIG. 4, indicated as being 90 degrees. However, the angle 16 must be adapted to both the production method and the function of the braided material 14 as either the only filtration device in the sand screen or as one of several.

Figure 5:
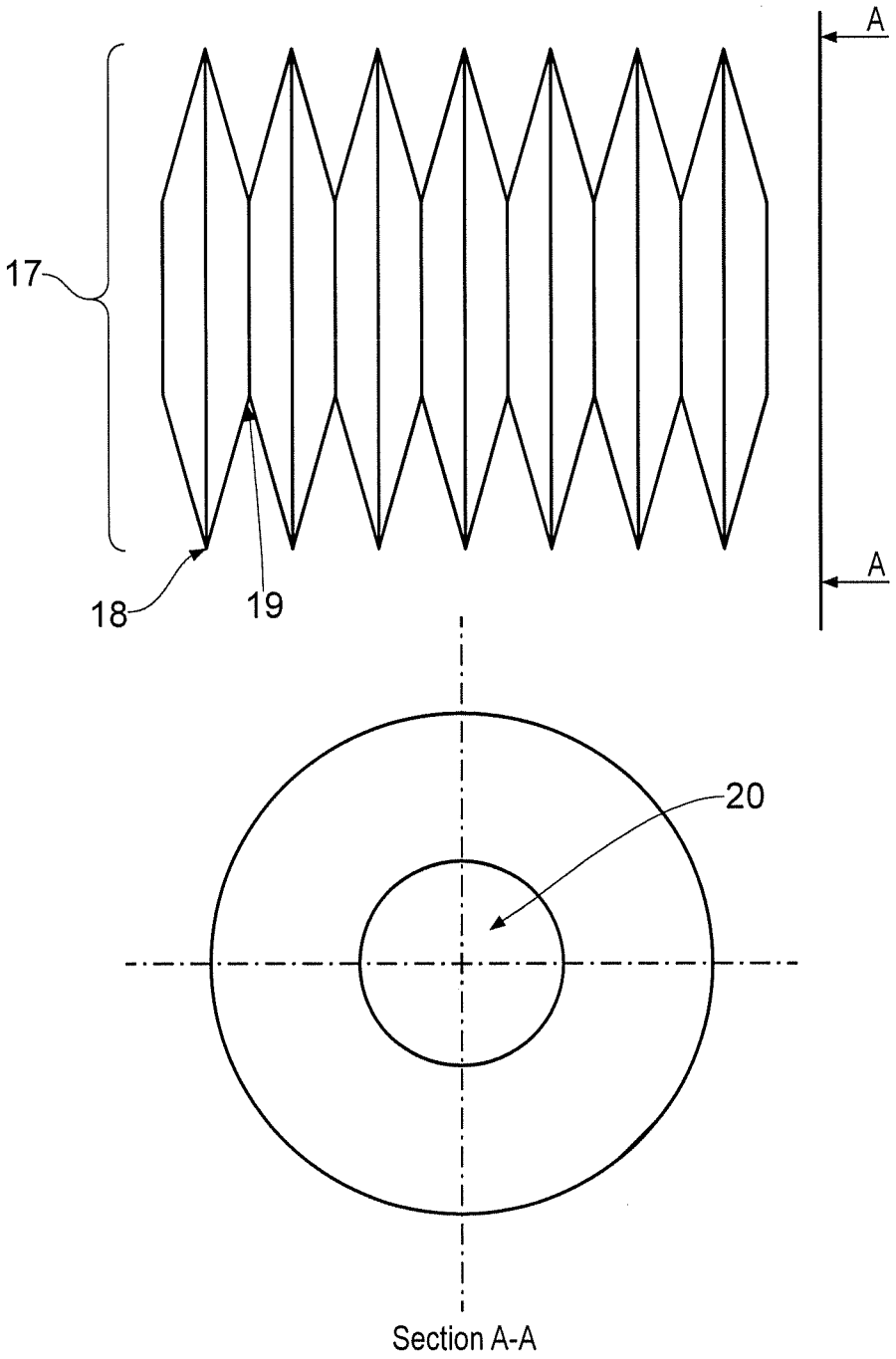
FIG. 5 is a schematic diagram of a flow-through element in the form of a bellows with sharp folds.

FIG. 5 is a schematic diagram of a portion of a flow-through element in the form of a tubular bellows 17 with sharp folds between alternately large 18 and small 19 external diameter, i.e., an alternating external diameter. This tubular bellows 17 can be one of a number of elements that make up the sand screen 9. The section A-A is taken looking in from the end of the tubular bellows 17, and shows the internal area 20 where liquid and/or gas can freely flow in one or other direction depending on the use of the lateral hole 7.

Figure 6:
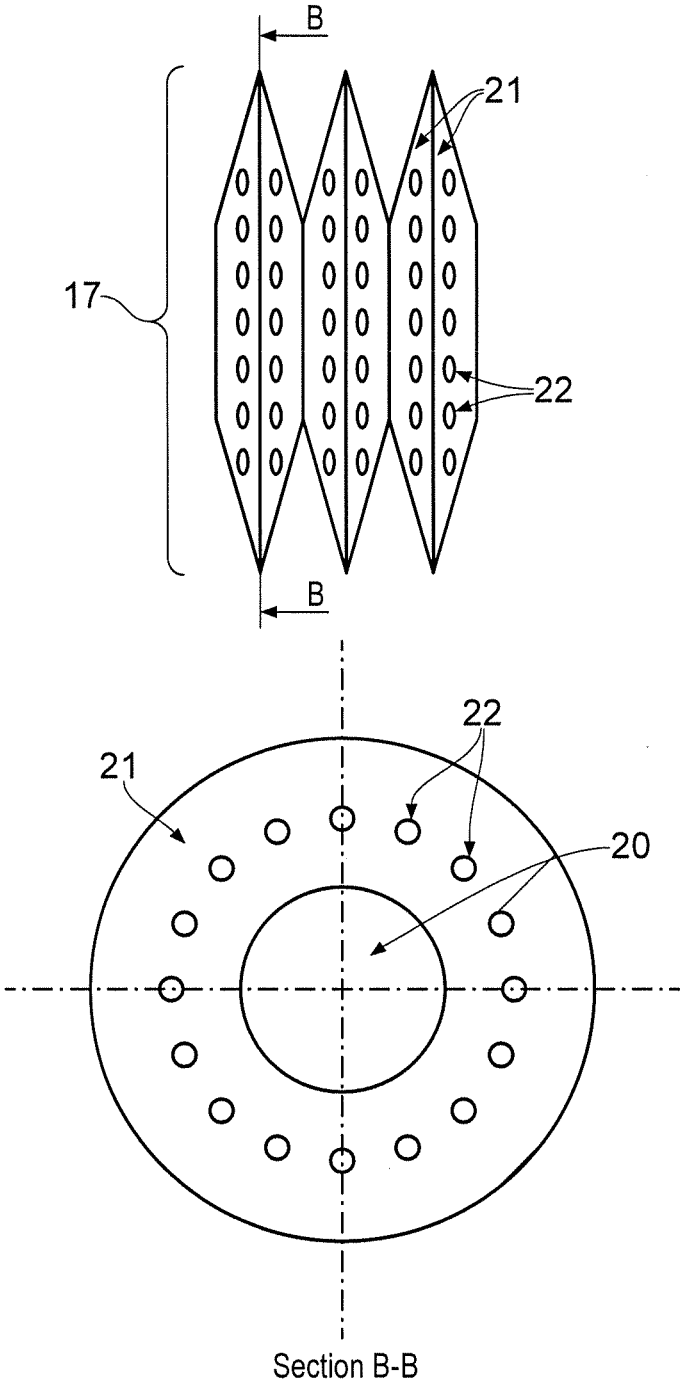
FIG. 6 is a schematic diagram of a flow-through element in the form of a bellows with sharp folds and openings where liquid and/or gas can flow through the pipe wall.

FIG. 6 is a schematic diagram of a portion of a tubular bellows 17. In this figure, the faces 21 of the bellows are provided with holes 22. Liquid and/or gas can flow through (in through and out through) the openings 22. The number of openings 22 and the diameter thereof are adapted to the dimensions of the sand screen 9 and the lateral hole 7.

Figure 7:
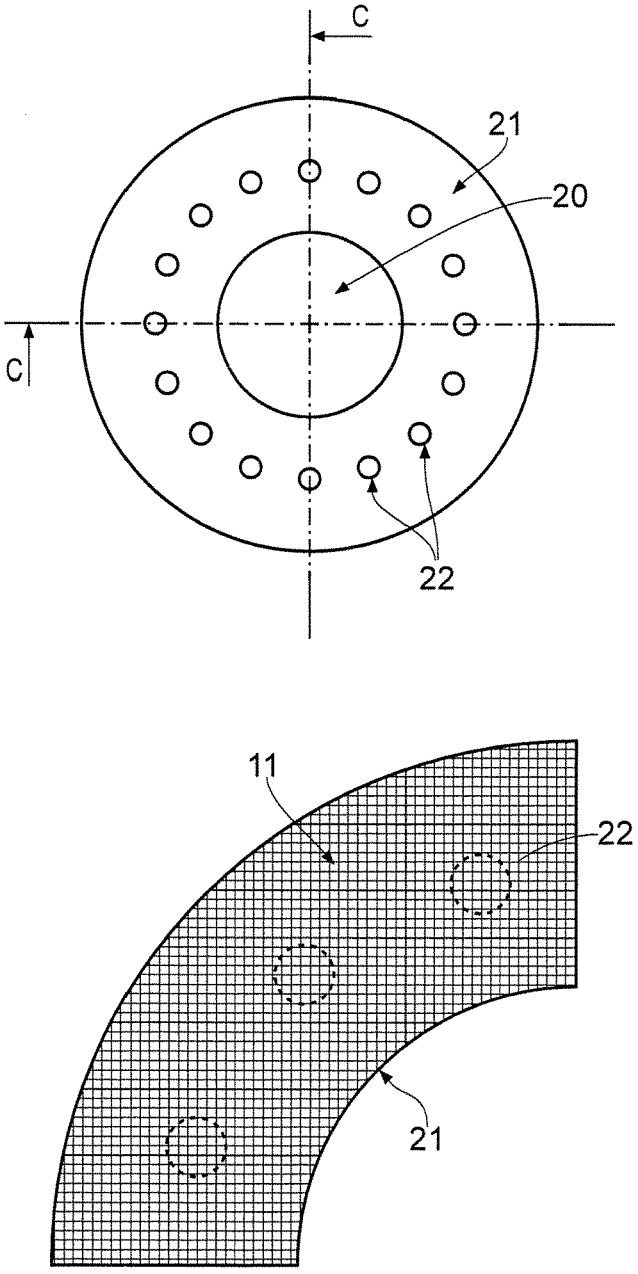
FIG. 7 is a schematic diagram showing a side view of a flow-through element in the form of a bellows with sharp folds, whilst the section in the figure is a diagram in which the inside of the bellows has had mounted thereon a filtration device in the form of a woven or braided material that prevents sand and particles from moving from the exterior of the sand screen to the interior.

FIG. 7 is a schematic diagram showing an end view of a flow-through element in the form of a tubular bellows 17. The face 21 of the bellows is provided with openings 22, and the internal flow area 20 of the sand screen 9 is also shown. The section C-C is taken looking towards the interior of the bellows face 21, which in this figure has mounted thereon a filtration device in the form of layers of woven material 11.

Figure 8:
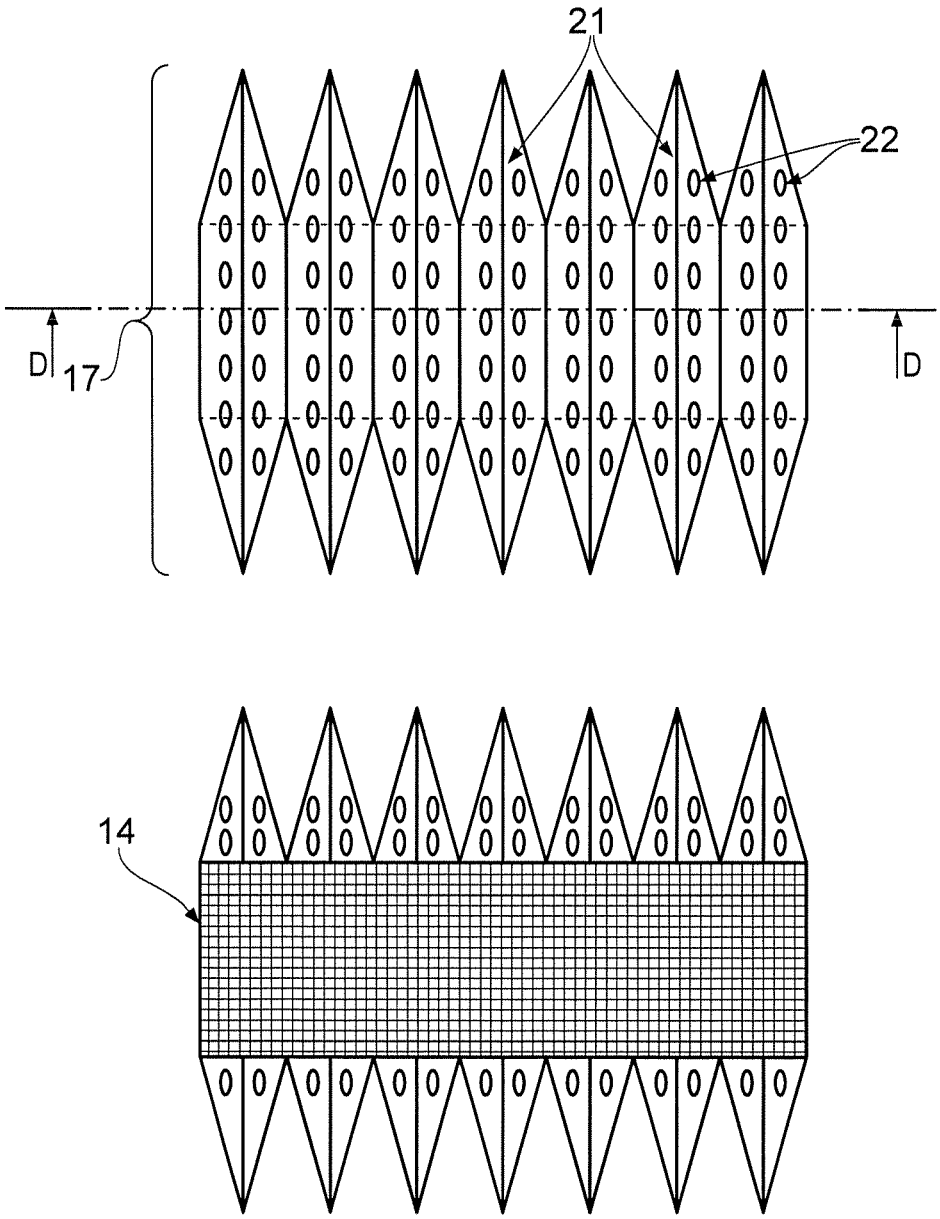
FIG. 8 is a schematic diagram showing a side view of a flow-through element in the form of a bellows with sharp folds, where the inside of the bellows/pipe is equipped with a filtration device in the form of a tubular woven or braided material that prevents sand and particles from moving from the exterior of the sand screen to the interior.

FIG. 8 is a schematic diagram showing a side view of a portion of a tubular bellows 17. The faces 21 of the bellows are provided with holes 22. Section D-D shows the bellows 17 seen from the inside, where the inside has mounted thereon, in this case, a filtration device in the form of a tubular braided material 14 which, together with the bellows 17, forms a sand screen 9.

Figure 9:
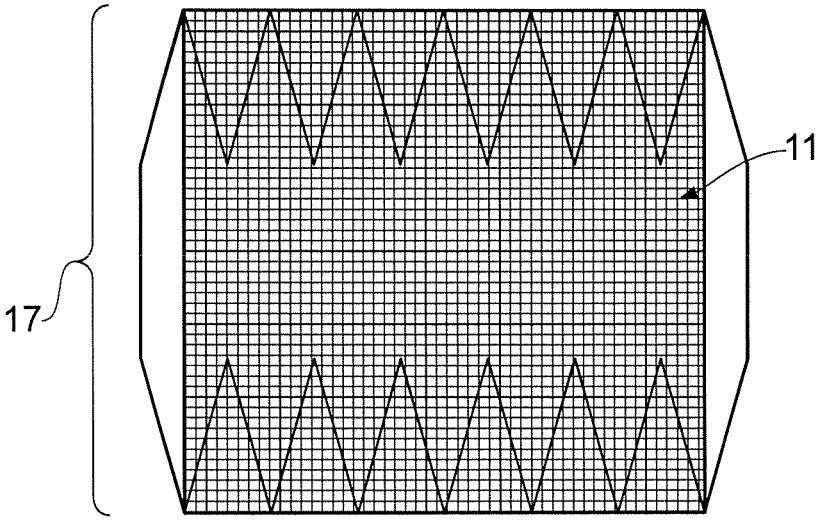
FIG. 9 is a schematic diagram showing a side view of a flow-through element in the form of a bellows with sharp folds, where the outside of the bellows/pipe is equipped with a filtration device in the form of a tubular woven or braided material that prevents sand and particles from moving from the exterior of the sand screen to the interior.

FIG. 9 is a schematic diagram showing a side view of a portion of a tubular bellows 17. On the outside of the tubular bellows 17, in this figure, is mounted a filtration device in the form of a tubular layer of woven material 11 which, together with the bellows 17, forms a sand screen 9.

Figure 10:
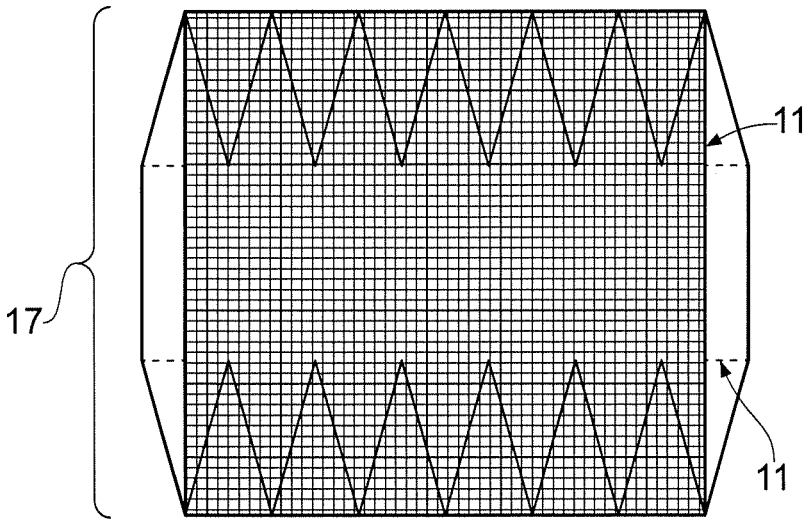
FIG. 10 is a schematic diagram showing a side view of a flow-through element in the form of a bellows with sharp folds, where both the outside and the inside of the bellows/pipe are equipped with a filtration device in the form of a tubular woven or braided material that prevents sand and particles from moving from the exterior of the sand screen to the interior.

FIG. 10 is a schematic diagram showing a side view of a portion of a tubular bellows 17. On the outside and the inside of the tubular bellows 17, in this figure, is mounted a filtration device in the form of a tubular layer of woven material 11. Together, the bellows 17, the external woven material 11 and the internal woven material 11 form a sand screen.

Figure 11:
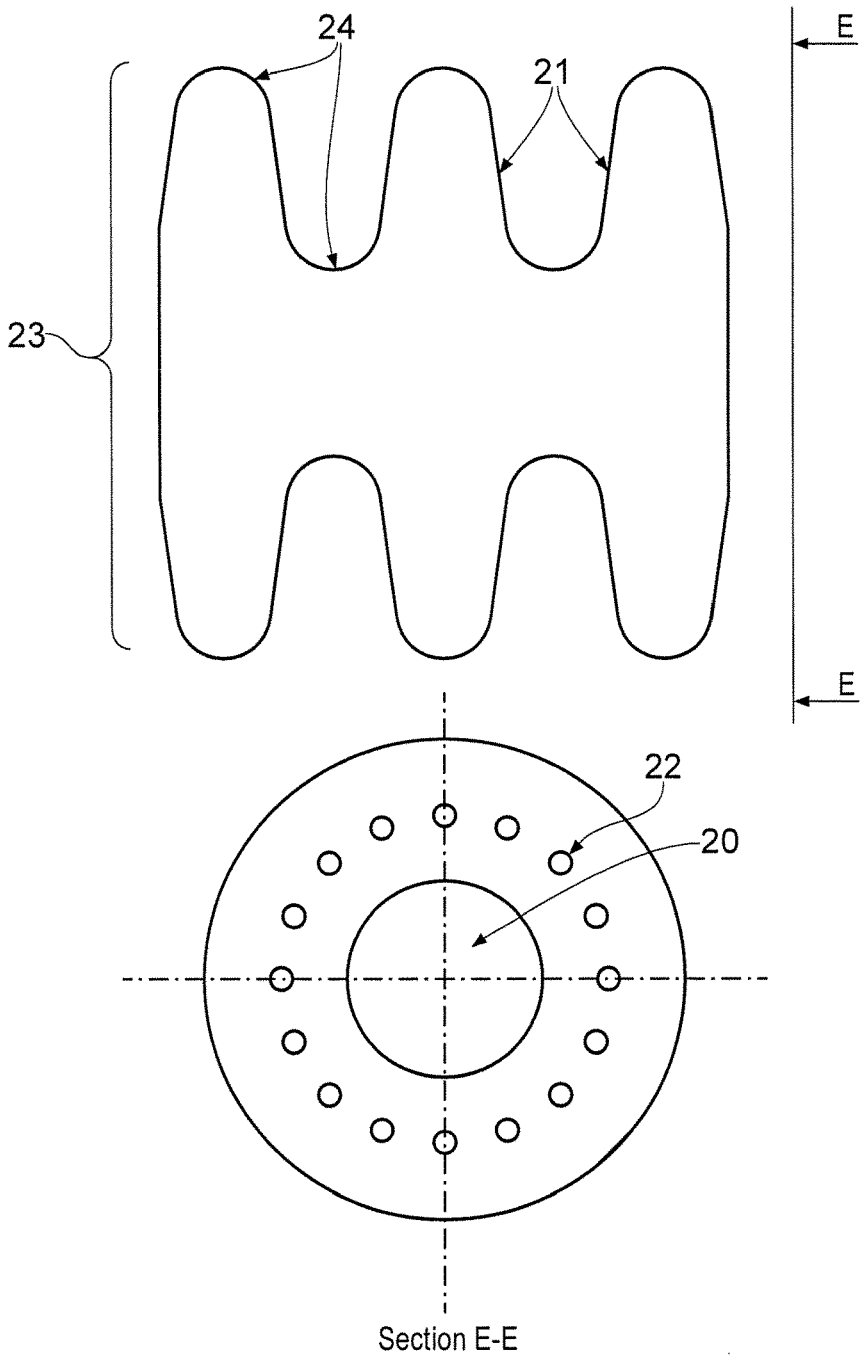
FIG. 11 is a schematic diagram showing a side view of a flow-through element in the form of a bellows with curved folds, where the bellows is equipped with openings that allow liquid and/or gas to flow though the pipe wall.

FIG. 11 is a schematic diagram showing a side view of a portion of a tubular bellows 17, where curved folds 24 are utilised between the straight faces 21 of the bellows 23. In section E-E it can be seen that the straight faces 21 are provided with openings 22 and that the bellows 23 has a passage in the centre that forms the internal flow area 20 of the sand screen 9.

Figure 12:
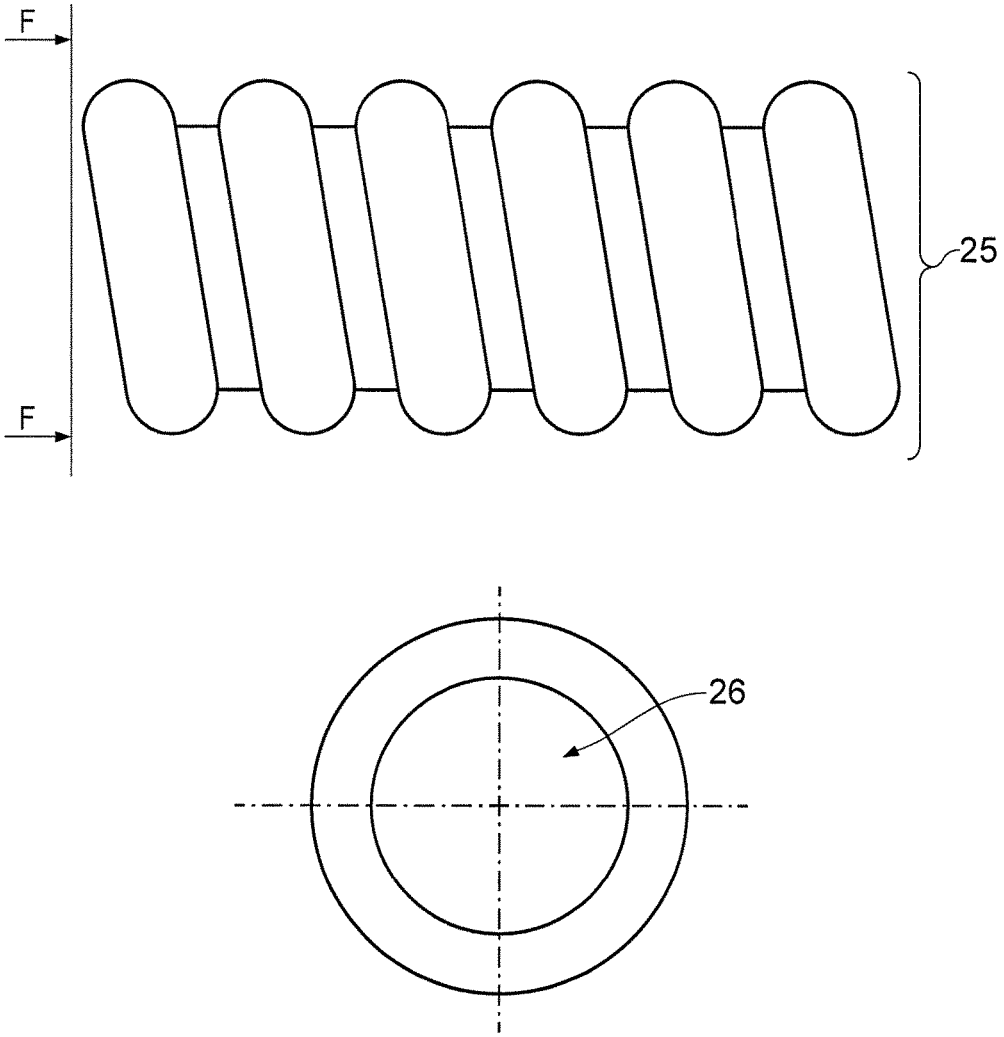
FIG. 12 is a schematic diagram of a flow-through element in the form of a spiral flexible pipe.

FIG. 12 is a schematic diagram showing a side view of a flow-through element in the form of a spiral flexible pipe 25. In an embodiment of a spiral flexible pipe, the spiral flexible pipe can be spun around a filtration device, or a second flexible pipe, where openings are formed at a later stage in the flexible pipe and the possible second flexible pipe. In another embodiment of a spiral flexible pipe, the flexible pipe can first be twisted before one or more flexible particle-obstructing elements are subsequently fixed in between adjacent parts of the spiral flexible pipe. This or the flexible particle-obstructing elements do not prevent bending of the sand screen, and are configured such that they can be stretched a great deal without tearing or ripping, and can return to their original form. In both embodiments, particles such as sand or other dirt are preventing from getting stuck and potentially holding the flow-through element open for influx of larger particles than is desirable. Section F-F is taken looking into this spiral flexible pipe 25 from the end, and here the internal flow area 26 of the pipe 25 can be seen.

Figure 13:
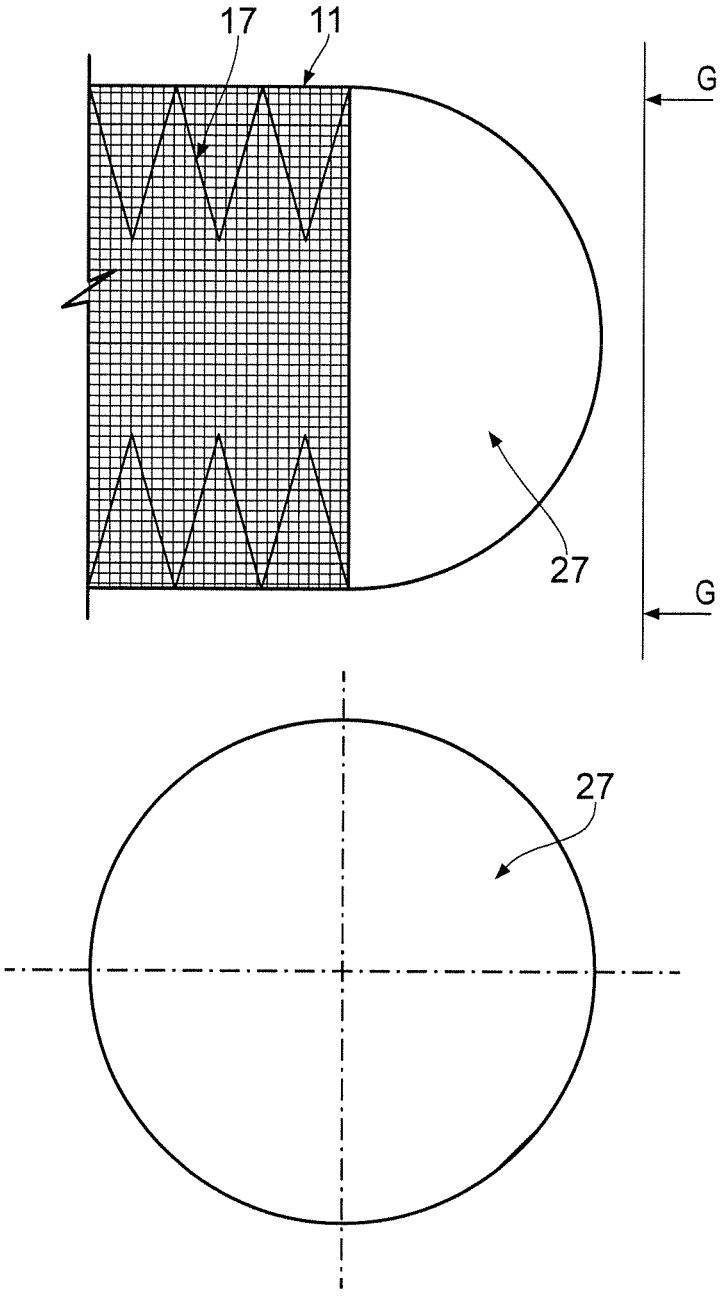
FIG. 13 is a schematic diagram of a termination in the form of a tip that is hemispherical in shape.

FIG. 13 is a schematic diagram showing a side view of a termination 8 in the form of a tip 27 having a hemispherical form. The tip 27 is shown together with a tubular bellows 17 that has been provided with a tubular layer of woven material 11 which, together with the bellows 17, forms a sand screen 9.

Figure 14:
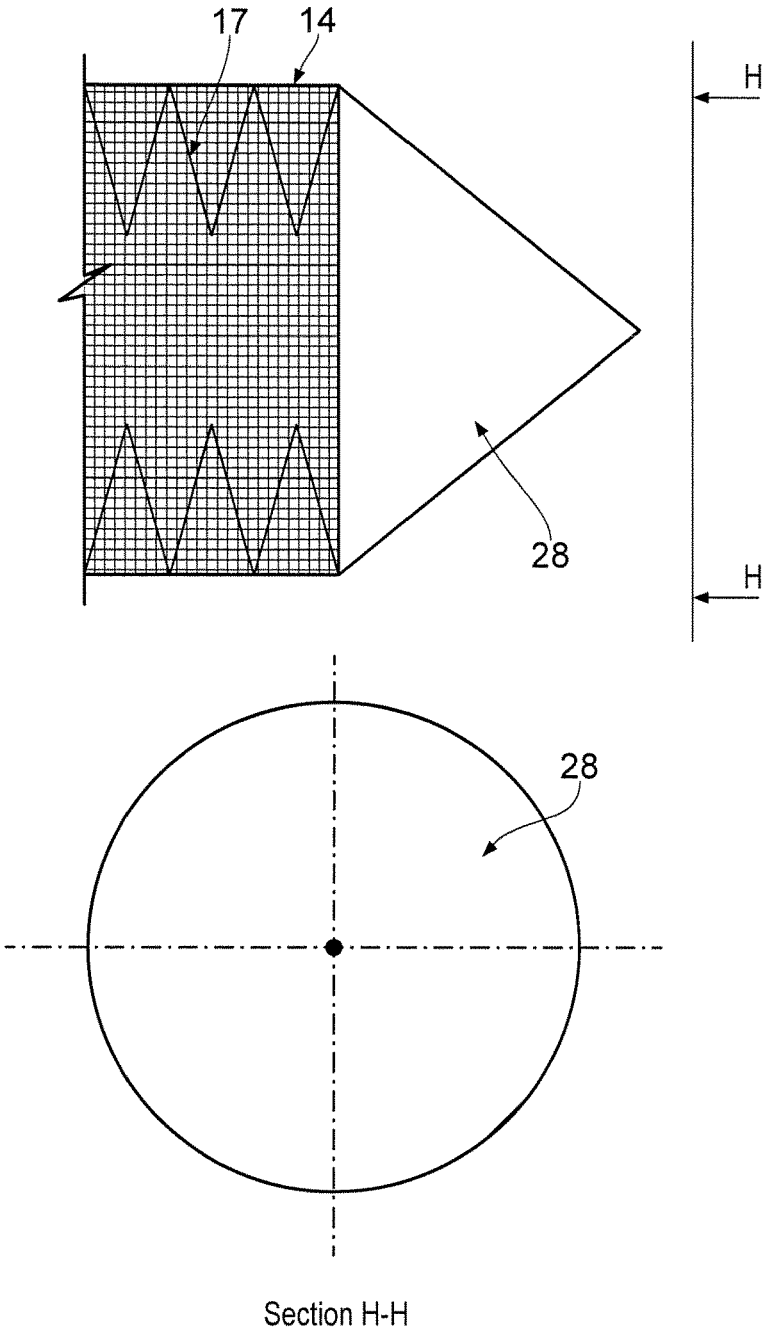
FIG. 14 is a schematic diagram of a termination in the form of a tip that is conical in shape.

FIG. 14 is a schematic diagram showing a side view of a termination 8 in the form of a tip having a conical shape 28. The tip is shown together with a tubular bellows 17 that has been provided with a tubular layer of braided material 14 which, together with the bellows 17, forms a sand screen 9.

Figure 15:
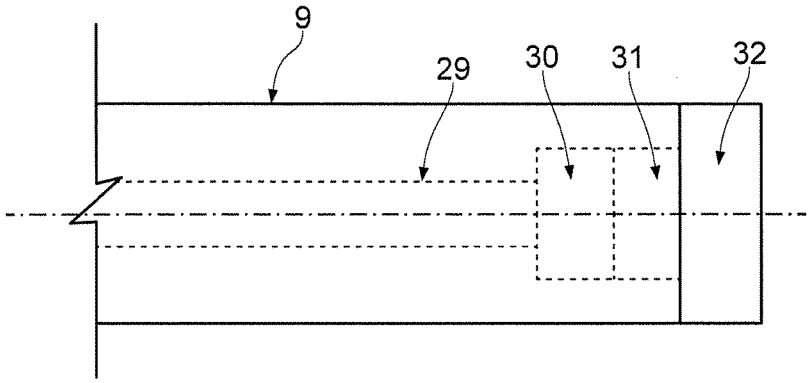
FIG. 15 is a schematic diagram of a sand screen that is equipped with a termination in the form of a tip capable of drilling the lateral hole as the sand screen is installed.

FIG. 15 is a schematic diagram of several juxtaposed elements. A sand screen 9 is attached to a drill bit 32 able to drill open the lateral hole at the same time as the sand screen 9 is installed. Behind this drill bit 32 is a one-way valve 31. This one-way valve 31 prevents liquid and/or gas, sand and particles from the lateral hole 7 from entering the interior of the sand screen 9 whilst allowing drilling fluid to be pumped out through the drill bit 32 during drilling of the lateral hole 7. Behind the one-way valve 31 is arranged a release mechanism 30. This release mechanism 30 allows disconnection from the drill pipe/drill string 29, optionally a hydraulic hose, when the lateral hole 7 has been drilled and the sand screen 9 has been installed.

Figure 16:
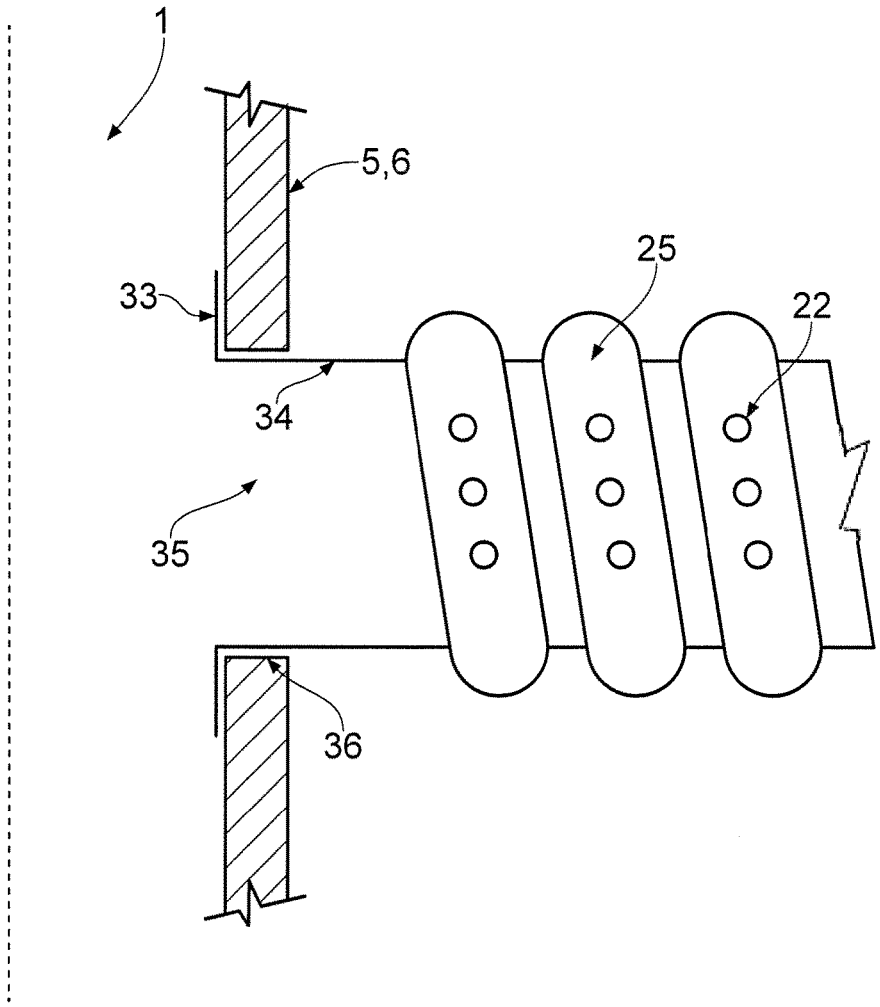
FIG. 16 is a schematic diagram of an end piece configured as a flange with associated pipe section.

FIG. 16 is a schematic diagram of an end piece 35 that is installed in a hole 36 in a casing 5 or a liner 6. In this case, the end piece 35 comprises of a flange 33 that abuts against either a liner 6 or a casing 5. This flange 33 is connected to a flow-through element in the form of a spiral and flexible pipe 25 by means of a short pipe section 34. In this figure, it is illustrated that the spiral and flexible pipe 25 is equipped with openings 22 that allow liquid and/or gas to flow into the spiral and flexible pipe 25, out through the end piece 35 and into the well 1.

Figure 17:
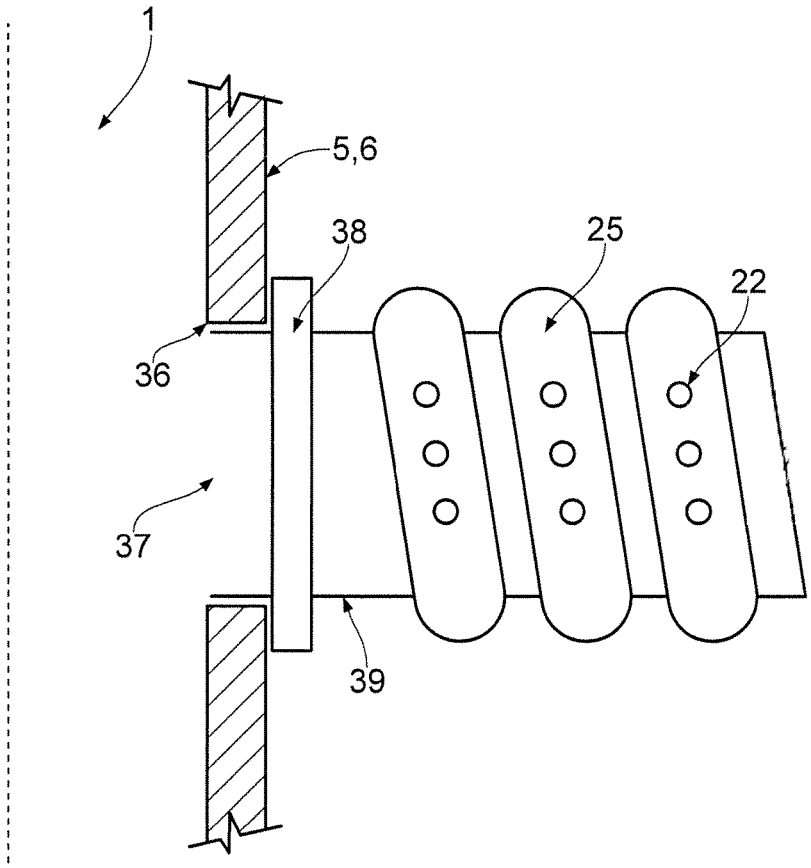
FIG. 17 is a schematic diagram of an end piece comprised of a pipe section with a mounted ring.

FIG. 17 is a schematic diagram of an end piece 37 that has been installed in a hole 36 in a casing 5 or a liner 6. In this case, the end piece 37 comprises a pipe section 39 that is provided with a ring 38 which, during installation, is pressed through the hole 36. The end piece 37 is connected to a spiral flexible pipe 25 by means of a short pipe section 39. In this figure it is illustrated that the spiral, flexible pipe 25 is equipped with openings 22 that allow liquid and/or gas to flow into the spiral flexible pipe 25, out through the end piece 37 and into the well 1.

Figure 18:
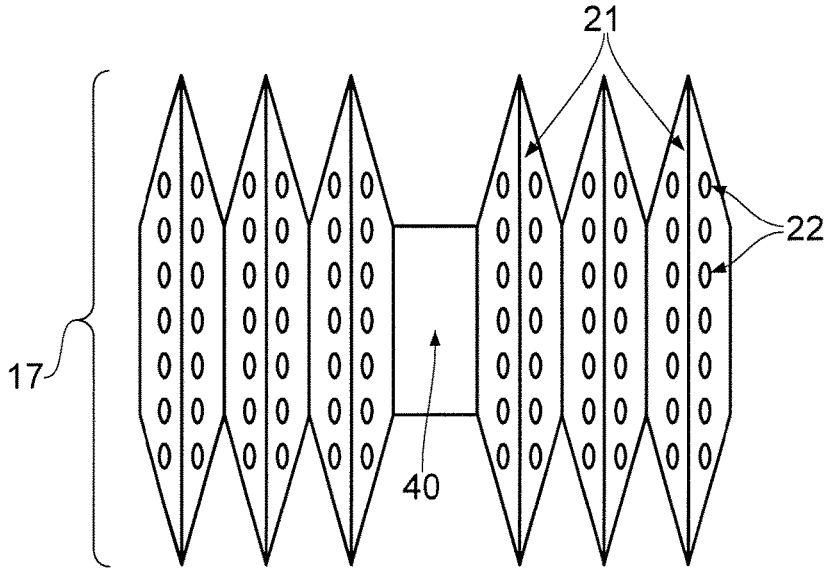
FIG. 18 is a schematic diagram of a sand screen with a flow-through element in the form of a bellows with sharp folds and holes where liquid and/or gas can flow through the pipe wall, where the sand screen is split into sections that are joined together by means of connecting pieces.

FIG. 18 is a schematic diagram of a portion of a tubular bellows 17 that comprises two elements joined together by a connecting piece 40. The figure shows that the faces 21 of the bellows are provided with openings 22. Liquid and/or gas can flow through (in through or out through) the openings 22.

Figure 19:
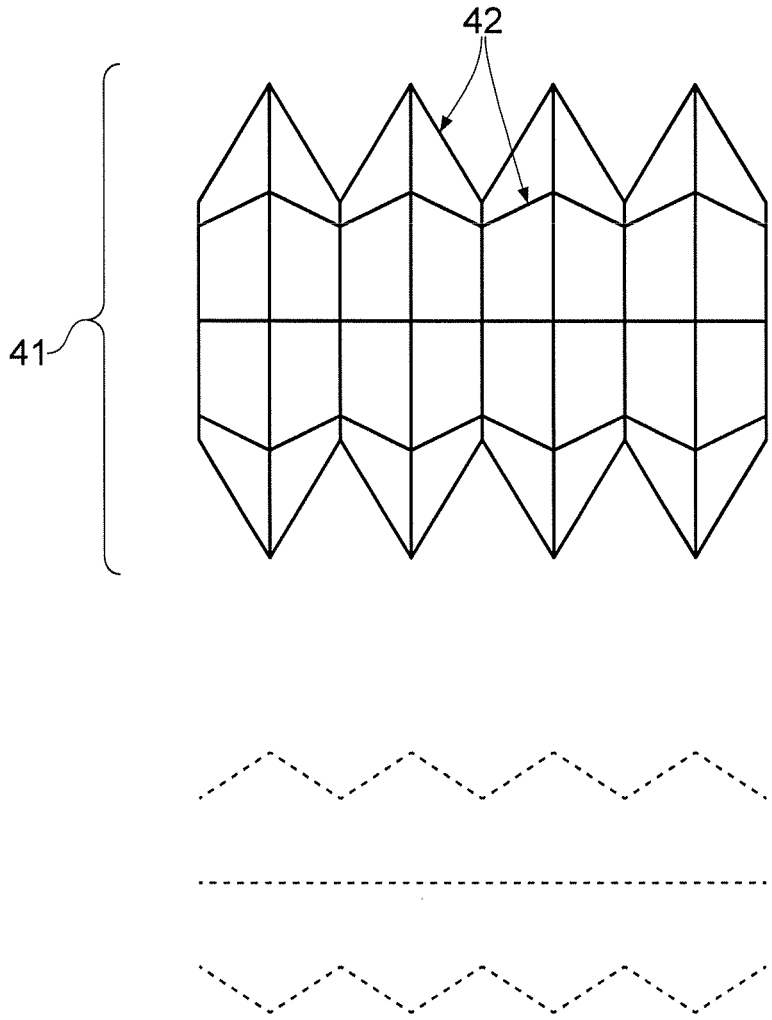
FIG. 19 is a schematic diagram of wires that form a framework having the shape of a bellows.

FIG. 19 is a schematic diagram of a flow-through element in the form of a framework 41 that has the shape of a bellows. This framework 41 is constituted of wires 42, which, in most cases, will be produced of steel adapted to the individual well conditions.

Figure 20:
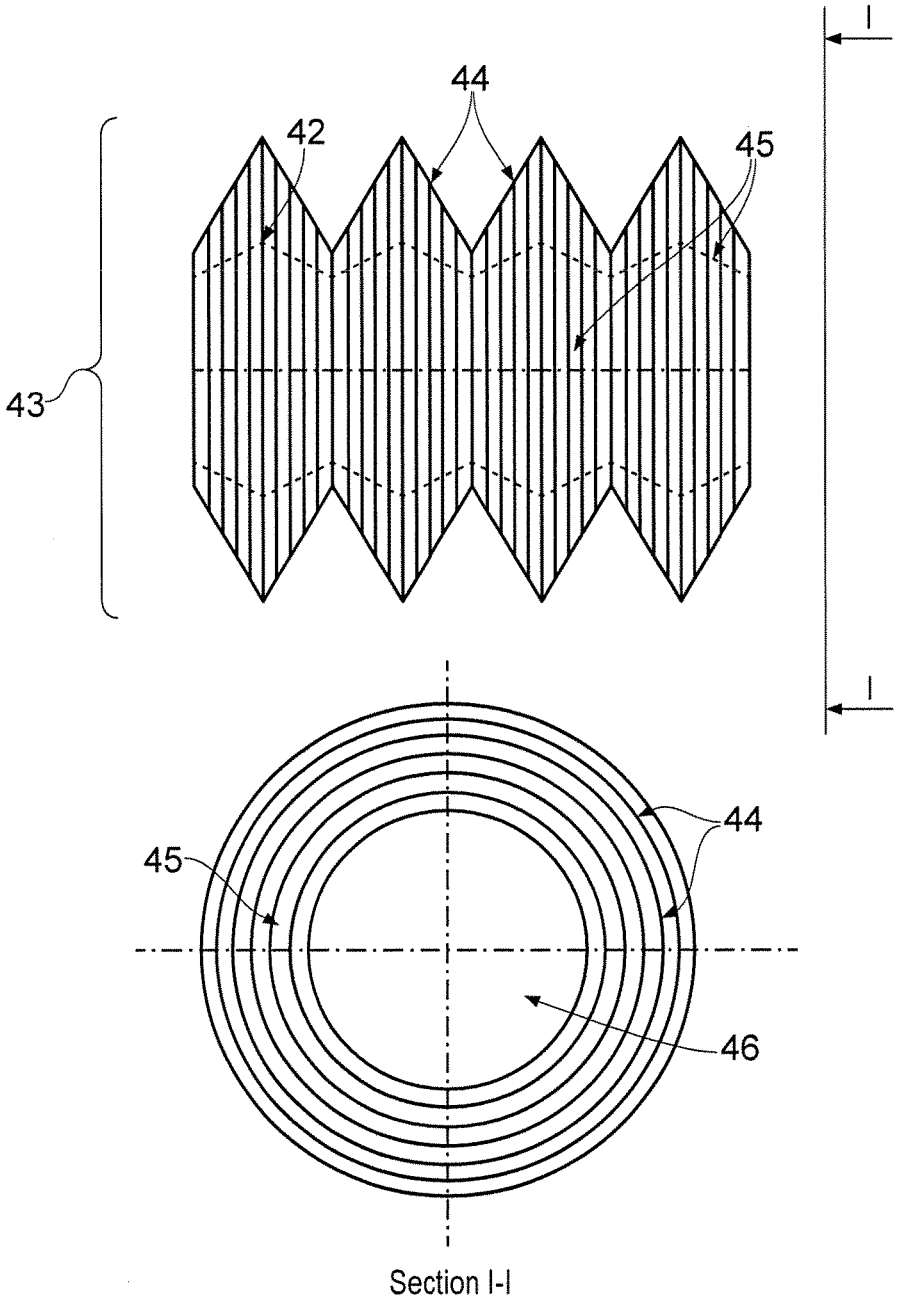
FIG. 20 is a schematic diagram of a sand screen comprising a flow-through element that forms a framework in the shape of a bellows that has mounted thereon an outer set of wires, which wires have the form of an equilateral trapezium.

FIG. 20 is a schematic diagram showing a side view of a flow-through element in the form of a piece of bellows-shaped pipe 43. The bellows-shaped pipe 43 functions as a sand screen 9. This bellows-shaped pipe 43 comprises a constructed framework 41 constituted of wires 42, the framework 41 being fastened to a filtration device in the form of wires 44 having a trapezoid cross-section. Between the wires 44 of trapezoid cross-section are openings in the form of slot openings 45 that are adapted to the sand and particles in the formation, such that the sand and particles are unable to pass through the slot openings 45. Liquid and/or gas can pass through the slot openings 45. Section I-I shows the bellows-shaped pipe 43 in the longitudinal direction. Here can be seen the internal flow area 46 of the bellows-shaped pipe 43 where liquid and/or gas can flow.

Figure 21:
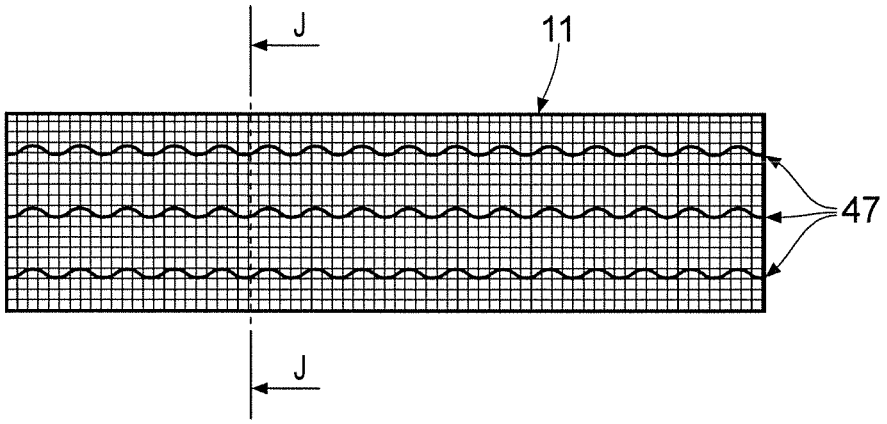
FIG. 21 is a schematic diagram of a sand screen constructed as a circular pipe made of a woven or braided material that has mounted thereon a number of flexible spacers.
Figure 21:
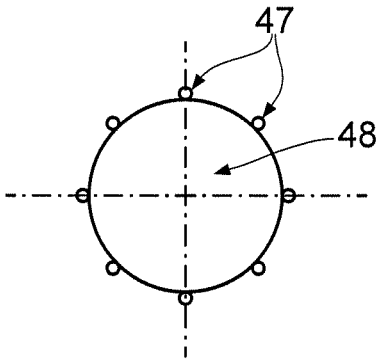

FIG. 21 is a schematic diagram of a sand screen 9 built up of a filtration device in the form of a woven material 11. The sand screen 9 has attached thereto spacers 47 on its outer radial surface. In section J-J, the spacers 47 are shown looking in the longitudinal direction of the sand screen 9. Here, the internal flow passage 48 of the sand screen 9 can also be seen.

Figure 22:
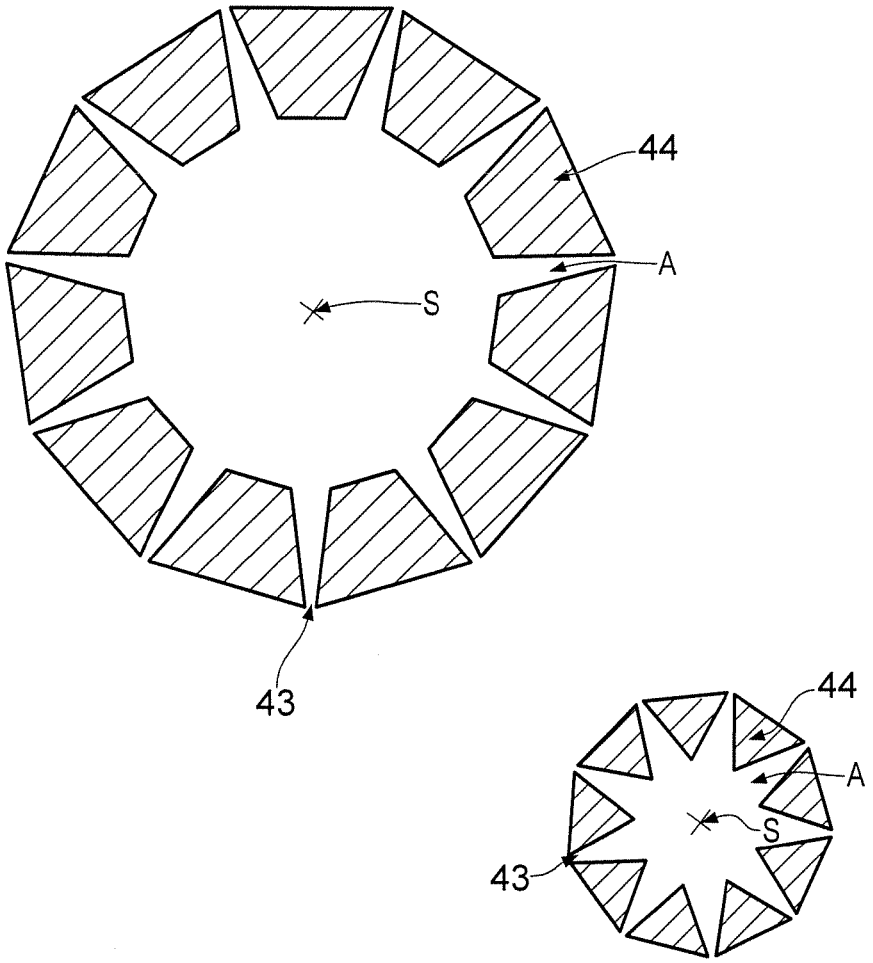
FIG. 22 shows details of the filtration device when constituted of a wire configured with a triangular or trapezoid cross-section, and details of the change in inflow area from the outside towards a centre line of the flow-through element.

FIG. 22 shows details of the filtration device seen from in front when constituted of a wire 44 configured with a triangular cross-section (bottom figure) or a trapezoid cross-section (top figure), and details of a change in inflow area A from the exterior of the sand screen towards a centre line S of the flow-through element. The wires 44 can be so arranged relative to one another that the inflow area A increases in the direction of the centre line S of the flow-through element. The wire 44 has a cross-section that decreases from an outer surface of the filtration device to an inner surface of the filtration device, and where subsequent wire(s), over the length of the filtration device, form an inflow area A between them. The wires 44 may have different cross-sections, for example, trapezoid. Alternatively, the wires may have a triangular cross-section, which will have an effect similar to wires of a trapezoid cross-section. The principle of using a trapezoid or triangular cross-section is the same, i.e., that sand will be stopped from entering the slot 43 between the wires. If sand does get into the narrow slot, the sand will flow on into the well and out of it. It is thus desirable to prevent sand from gathering between the wires. These lie adjacent to one another such that there are slot openings between them.

Figure 23:
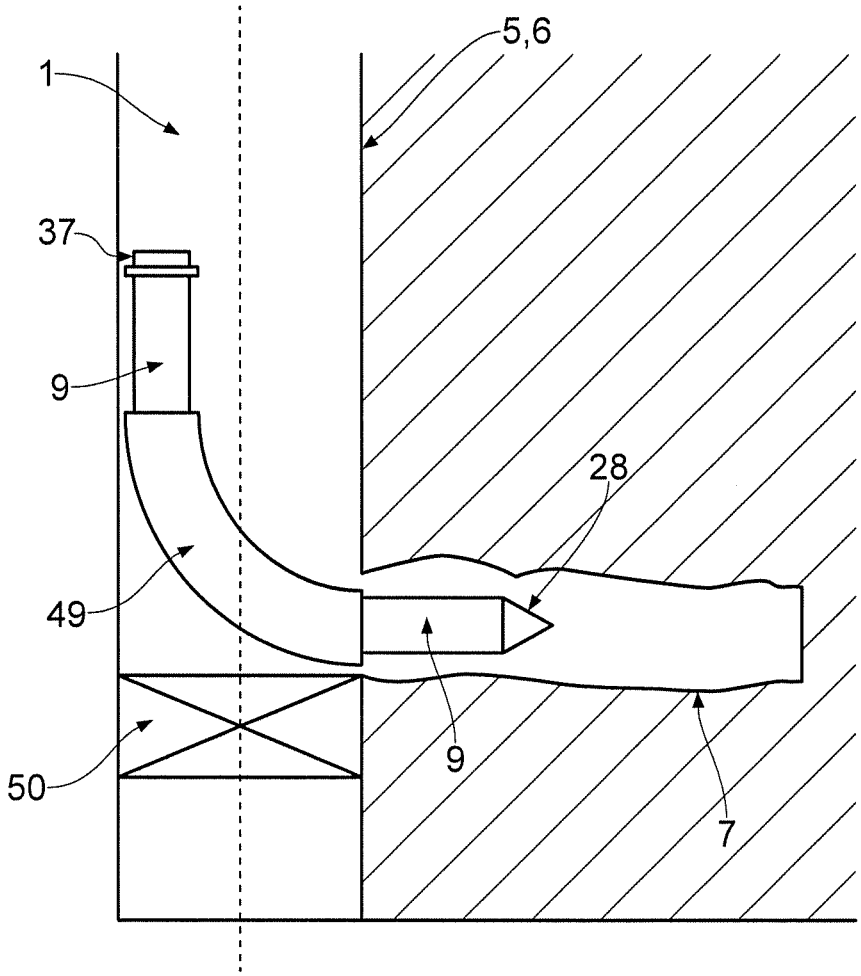
FIG. 23 is a schematic diagram showing the installation of the sand screen in a lateral hole that has already been drilled.

FIG. 23 is a schematic diagram of a termination in the form of a tip 28, a sand screen 9 and an end piece 37 installed in a well 1 through a hole in a casing 5 or a liner 6 and out into a lateral hole 7. In this process, an anchor 50 can be used that forms a floor for a conductor casing 49 that is so positioned in the well 1 that the sand screen 9 with associated components is guided out into the lateral hole 7.

Embodiments of the invention have been described with reference to specific details in the drawings, but it is obvious that a person of skill in the art could make modifications or changes to the embodiments without departing from the scope of the invention as defined in the attached claims. For example, it is possible for the wires to have another cross-section than triangular or trapezoid, as long as two subsequent axial wires along the flow-through element provide an increasing inflow area.

What is claimed is:

1. A sand screen for installation in a well comprising:

a flow-through element having a centre line running in a longitudinal direction of the flow-through element, the flow-through element, in the longitudinal direction having an alternating external diameter; and a filtration device arranged on an inside or an outside of the flow-through element, wherein the flow-through element has an internal cavity extending over at least parts of a length of the flow-through element, wherein the flow-through element is further configured with a plurality of openings along the length thereof and wherein the filtration device covers the plurality of openings in the flow-through element, the openings, via the filtration device, providing communication between an outer surface of the flow-through element and the internal cavity, and wherein the sand screen is flexible in a radial direction and in an axial direction in that the sand screen is bendable at least 90° through 360° over a length of 30 cm.

2. The sand screen according to claim 1, wherein the flow-through element comprises a pipe, a framework, a spiral pipe or a bellows.

3. The sand screen according to claim 1, wherein the filtration device is comprised of wires in the form of a woven mesh, a braided mesh or spiral wires.

4. The sand screen according to claim 3, wherein the wires are configured with a cross-section that decreases from an outer surface of the filtration device towards an inner surface of the filtration device, and wherein subsequent wire(s), over a length of the filtration device, form an inflow area between the outer surface and the inner surface.

5. The sand screen according to claim 4, wherein the wires are so arranged in relation to one another that the inflow area increases in the direction of the centre line of the flow-through element.

6. The sand screen according to claim 1, wherein the sand screen comprises at least one spacer on an outer surface of the sand screen.

7. The sand screen according to claim 1, wherein the sand screen comprises a termination.

8. The sand screen according to claim 7, wherein the termination is fluid-tight.

9. The sand screen according to claim 7, wherein the termination comprises a drill bit and at least one of a stand of drill string, a one-way valve, or a release mechanism.

10. The sand screen according to claim 9, further comprising at least one layer which at least reduces fluid communication between an outer surface of the sand screen and the internal cavity.

11. The sand screen according to claim 10, wherein the at least one layer is capable of being activated by a change in at least one of pressure, temperature, or chemicals.

* * * * *